US006379598B1

(12) United States Patent
Bjur et al.

(10) Patent No.: US 6,379,598 B1
(45) Date of Patent: Apr. 30, 2002

(54) VISCOSE SPIN BATH ADDITIVE OF AN AMPHOTERIC SURFACTANT

(75) Inventors: Kent Bjur, Stenungsund; Anders Cassel, Myggenäs; Margreth Strandberg, Stenungsund; Ingemar Uneback, Svenshögen, all of (SE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 09/477,243

(22) Filed: Jan. 4, 2000

Related U.S. Application Data

(63) Continuation of application No. PCT/SE98/00800, filed on Apr. 30, 1998.

(30) Foreign Application Priority Data

Jul. 14, 1997 (SE) ..... 9702703

(51) Int. Cl.[7] ..... C08L 1/24; D01F 2/08
(52) U.S. Cl. ..... 264/189; 106/166.4
(58) Field of Search ..... 264/189; 106/166.4

(56) References Cited

U.S. PATENT DOCUMENTS 2,937,922 A * 5/1960 Mitchell et al. ..... 264/189

OTHER PUBLICATIONS

Derwent Abstract, JP73006409, dated Sep. 1973.
Derwent Absract, JP54101916, dated Aug. 10, 1979.
International Search Report, dated Aug. 17, 1998.

* cited by examiner

*Primary Examiner*—Leo B. Tentoni
(74) *Attorney, Agent, or Firm*—Ralph J. Mancini; Lainie E. Parker

(57) ABSTRACT

A method of reducing the clogging of nozzles and slits and diminishing the formation of deposits in a spin bath system in a process of making viscose filamentary and film materials by using, as a spin bath additive, an amphoteric surfactant having the formula I, and a spin bath system including an amphoteric surfactant having the formula I $$\mathrm{RNA}\,(\mathrm{C}_n\mathrm{H}_{2n}\mathrm{NA})_{x-1}\mathrm{A} \qquad \text{(I)}$$

where R represents a hydrogen or an aliphatic group with 1–24 carbon atoms, each A represents a hydrogen, an aliphatic group with 1–24 carbon atoms, or $\mathrm{BOOCC}_m\mathrm{H}_{2m}$— groups, where m is a number from 1–3, B is hydrogen or a salt forming cation, n is a number from 2–3, x is 1–8, and the number of $\mathrm{BOOCC}_m\mathrm{H}_{2m}$— groups are from 1 to x+2, with the provision that the total number of carbon atoms in the aliphatic groups is from 8 to 45. The amphoteric surfactant has an excellent anticlogging effect, since it is a good dispersant and prevents or reduces precipitation in the spin bath. In addition it exhibits low foaming and is very stable.

10 Claims, No Drawings

VISCOSE SPIN BATH ADDITIVE OF AN AMPHOTERIC SURFACTANT

RELATED APPLICATION

This application is a continuation of PCT/SE98/00800 filed Apr. 30, 1998 which was published on Jan. 29, 1999 as International Publication Number WO 99/04070 and claims priority of Swedish Application no. 9702703-1 filed on Jul. 14, 1997.

FIELD OF THE INVENTION

The present invention relates to a method of reducing the clogging of nozzles and slits and diminishing the formation of deposits in a spin bath system in a process of making viscose filamentary and film materials by using an amphoteric surfactant.

BACKGROUND OF THE INVENTION

When regenerating cellulose material in an acidic spin bath containing zinc sulphate, clogging disturbancies are frequent. The origins of the clogging material are different. One and the most important source are solid by-products, i.e., elementary sulphur and zinc sulphide, which are formed when the dissolved xanthogenated celluloses are regenerated to cellulose and carbon disulphide. Other examples of by-products are hemicelluloses and resins derived from the cellulosic raw material itself and transfered to the spin bath where they cause deposits.

One method of reducing these disadvantages is to add cationic surface active compounds to the spinning baths. Thus, in Japanese Patent No. 48006409 it is suggested to add N,N'-polyoxyethylene-N-long chain-alkyl alkylene-diamines and N,N',N"-polyoxyethylene-N-long chain-alkyl alkylene-triamines into the spin bath as dispersants for sulphur particles which cause blockages in spinning nozzles. The long-chain alkyl group contains from 10 to 20 carbon atoms. The number of oxyethylene groups are from 1 to 8 for each substitution position and their sum is from 2 to 10. However, these additives have a rather limited ability to disperse sulphur, especially when the amount thereof is high.

In Japanese Patent Application No. 54101916 it is suggested to add polyoxyethylene alkyl mono- and diamide polyalkylene polyamines to further reduce the clogging of nozzles. Examples of the used polyalkylene polyamines are triethylene tetramine and tetraethylene pentamine. The number of carbons in the fatty acids used for preparing the compounds is preferably from 12 to 22, while the number of ethylene oxide groups in the molecule is from 6 to 12. Although these polyamines have a good dispersing effect they have a serious drawback since they are not stable in hot acid solutions and are hydrolyzed at high temperature in the spin bath. Consequently, after some time their effect is essentially reduced.

The degradation of the additive can be compensated by addition of higher dosages of the additives. However, in practice the resulting products of the hydrolysis, i.e., the fatty acids produced especially during reconditioning of the spin bath enhances the clogging. Together with elementary sulphur and/or zinc sulphide and resins they form black particles, which are very difficult to disperse.

SUMMARY OF THE INVENTION

It has now been found that not only the disturbancies of clogging materials in the spin bath are essentially diminished but also the quality of the fibers formed in the spin bath is improved by using an amphoteric surfactant having the formula I $$\text{RNA}\ (C_nH_{2n}NA)_{x-1}A \qquad \text{(I)}$$

where R represents a hydrogen or an aliphatic group with 1–24 carbon atoms, each A represents a hydrogen, an aliphatic group with 1–24 carbon atoms, or $BOOCC_mH_{2m}$— groups, where m is a number from 1–3, B is hydrogen or a salt forming cation, n is a number from 2–3, x is 1–8, and the number of $BOOCC_mH_{2m}$— groups are from 1 to x+2, with the provision that the total number of carbon atoms in the aliphatic groups is from 8 to 45, as a viscose spin bath additive.

DETAILED DESCRIPTION OF THE INVENTION

The invention is a spin bath additive of an amphoteric surfactant having the formula I $$\text{RNA}\ (C_nH_{2n}NA)_{x-1}A \qquad \text{(I)}$$

where R represents a hydrogen or an aliphatic group with 1–24 carbon atoms, each A represents a hydrogen, an aliphatic group with 1–24 carbon atoms, or $BOOCC_mH_{2m}$— groups, where m is a number from 1–3, B is hydrogen or a salt forming cation, n is a number from 2–3, x is 1–8, and the number of $BOOCC_mH_{2m}$— groups are from 1 to x+2, with the provision that the total number of carbon atoms in the aliphatic groups is from 8 to 45, as a viscose spin bath additive.

The amphoteric surfactant has an excellent anticlogging effect, since it is a good dispersant and prevents or reduces precipitation in the spin bath. In addition, it has low foaming and is very stable in comparison with the amide compounds disclosed in JP Patent Application No. 54101916. Since the additive keeps the openings in the spinneret free from clogging materials, the filaments and films formed collect fewer solid particles, whereby the discoloration is reduced and the fiber or film strength improved. The maintainance of the spin bath is also simplified, since the amphoteric surfactant is stable in ordinary working-up-processes of the spin bath and the spin bath solution can be recirculated after the removal of an excess of the by-products including sodium sulphate obtained in the spin bath. The amount of the amphoteric compound in the spin bath may be varied within wide limits, but is normally added in an amount of 0.5–5000 ppm, preferably from 2 to 1500 ppm, to a spin bath containing 5–15% by weight $H_2SO_4$, 15–30% by weight of $Na_2SO_4$ and 0–7% by weight of $ZnSO_4$.

The amphoteric surfactant of formula I preferably contains one or two aliphatic groups, R and A, with a total of 8 to 40 carbon atoms, preferably from 10 to 36 carbon atoms. Preferably R is a hydrocarbon group with 8–24 carbon atoms, and most preferably 10–22 carbon atoms. B is normally a mono- or divalent, preferably a monovalent cation, m is preferably a number 1 or 2.

Most preferred amphoteric surfactants of the formula I are those having the formula $$\text{RNA}\ (C_3H_6NA_1)_{x-1}A_1 \qquad \text{(II)}$$

where R, A and x have the meaning mentioned in formula I and $A_1$ is a hydrogen or a group $BOOCC_mH_{2m}$, where B and m have the meaning mentioned in formula I. These additives are easy to produce and have excellent dispersing ability. Normally at least 50% of all substituents A and $A_1$ are the group $BOOCC_mH_{2m}$—. The amphoteric surfactants where m is 1 are preferred, since they exhibit low foaming. Low foaming is also supported by the presence of at least one R group with 14–22 carbon atoms. This is of benefit in the sequent treatment of the fiber and film material.

The present invention also relates to a process for regeneration of cellulose from a viscose solution, in which process the viscose solution is brought into contact with a spin bath containing from 0.5 to 5000 ppm of an amphoteric surfactant according to formula I. Preferably the amphoteric surfactant has the formula II. The spin bath normally has a temperature of from 40° C. to 60° C. and contains in addition to the amphoteric surfactant from 5 to 15% by weight of $H_2SO_4$, from 15 to 30% by weight of $Na_2SO_4$ and from 0–7% by weight of $ZnSO_4$. The regenerated cellulose may have the form of fibers or films or any other conventional shape.

The invention is further illustrated by the following examples.

EXAMPLE 1

Degradation kinetics of two spin bath additives were evaluated in a spin bath with the composition 9.5% $H_2SO_4$, 23% $Na_2SO_4$, 0.4% $ZnSO_4$ and 67.1% $H_2O$ at different temperatures stated in the tables below.

One of the additives was an amide condensate of tetraethylene pentamine and a tallow fatty acid ethoxylated with 10 moles ethylene oxide per mol amide, hereinafter referred to as Compound B. Compound B is a typical representative of an additive in the Japanese Patent Application No. 54101916. The other additive was an oleoamphopolycarboxyglycinate, RNA $(C_nH_{2n}NA)_{x-1}A$ where R is a $C_{18}$-hydrocarbon group derived from oleic fatty acid, x is 4, n is 3, and A is the group $BOOCC_mH_{2m}$, where B is a sodium cation and m is 1, hereinafter referred to as Compound 1. It is a typical representative of an amphoteric surfactant according to this invention.

The content of Compound B in the spin bath was analyzed by using the dye Orange II. This dye and the cationic surfactant were reacted and the complex formed was extracted into chloroform. Then, the amount of the complex in the chloroform phase was spectrophotometrically determined at a wave length of 488 nm. The amphoteric surfactant, Compound 1, was analyzed by first concentrating the surfactant on a Dionex On Guard-RP column followed by eluation in an aqueous alkaline acetonitrile solution. The concentration of the amphoteric surfactant was then determined by an HPLC method under the following conditions: Column, Hamilton PRP-1; Detection, UV 230 nm; Mobil phase, Gradient of acetonitrile in alkaline water; Flow rate, 1 ml/min. All data are presentated below in Tables 1 and 2, respectively.

The figures show the residual non-degraded amount of Compound B and Compound 1 in %.

TABLE 1.

| | Content of Compound B, % | | | |
|---|---|---|---|---|
| | Temperature | | | |
| Time, h | 22° C. | 50° C. | 70° C. | reflux |
| 0 | 100 | 100 | 100 | 100 |
| 6 | 90 | 80 | 70 | 35 |
| 24 | 90 | 75 | 60 | 20 |
| 48 | 90 | 65 | 50 | 15 |

TABLE 2.

| | Content of Compound 1, % | | | |
|---|---|---|---|---|
| | Temperature | | | |
| Time, h | 22° C. | 50° C. | 70° C. | reflux |
| 0 | 100 | 100 | 100 | 100 |
| 6 | 99 | 98 | 96 | 89 |
| 24 | 98 | 95 | 93 | 85 |
| 48 | 97 | 95 | 90 | 81 |

From the results it is evident that the stability in hot spin bath is much lower for the amide type of spin bath additive (Compound B) than for the additive according to the invention (Compound 1).

EXAMPLES 2–4

Precipitation prevention and dispersing capacities of some spin bath additives were determined according to the following procedure.

21 ml of a solution containing 0.25 M $Na_2S_2O_3$, 0.15 M $Na_2CS_3$ and 0.25 M $Na_2S$ was added dropwise during stirring into a polypropylene vessel containing 1 liter of a spin bath. The spin bath had a composition of 10% $H_2SO_4$, 20% $Na_2SO_4$, 1% $ZnSO_4$ and 69% $H_2O$. Its temperature was 50° C. The stirrer was made of glass with a propellar of platinum. After the addition, the transmittance of the bath was measured after predetermined times in a spectrophotometer at the wave length of 450 nm in a glass cuvette. During the whole test the stirring was kept constant at 300 rpm. After 270 minutes, the test was interrupted and the weight of the stirrer was measured in order to determine the amount of material precipitated on the stirrer.

The precipitation preventing and dispersing additives were added in different amounts to the spin bath before the start of adding the 21ml solution to the spin bath solution.

The following additives were used.

Compound A.

A compound having the formula $$(EO)_yH$$

$$C_{18}\text{-alkyl } N(EO)_x—C_3H_6N$$

$$(EO)_zH$$

where EO is ethyleneoxy and the sum of x, y and z is 10, in accordance with the amine compounds disclosed in the Japanese Patent No. 48006409.

Compound B.

Same compound as in Example 1.

Compound 1.

Same compound as in Example 1.

Compound 2.

Tallowamphopolycarboxyglycinate of formula I, where R is a tallow fatty alkyl group, x is 4, n is 3 and A is $BOOCC_mH_{2m}$—, where B is sodium and m is 1.

Compound 3.

Tallowamphopolycarboxypropionic acid of formula I, where R, A, n, and x have the same meanings as in Compound 2, and m is 2 and B is hydrogen.

The tests performed and the results obtained are shown in Table 3 below.

TABLE 3

| | Transmittance, % Compound | | | | | | | | | | | |
|---|---|---|---|---|---|---|---|---|---|---|---|---|
| | — | A | A | B | 1 | 1 | 2 | 2 | 3 | 3 | 3 | 3 |
| | Amount | | | | | | | | | | | |
| Time, min | — | 5 ppm | 25 ppm | 5 ppm | 5 ppm | 25 ppm | 5 ppm | 25 ppm | 5 ppm | 25 ppm | 250 ppm | 500 ppm |
| 0 | 100 | 100 | 100 | 100 | 100 | 100 | 100 | 100 | 100 | 100 | 100 | 100 |
| 30 | 57 | 71 | 67 | 39 | 75 | 93 | 86 | 77 | 84 | 71 | 76 | 79 |
| 60 | 52 | 41 | 48 | 25 | 31 | 37 | 36 | 44 | 35 | 41 | 56 | 54 |
| 120 | 47 | 38 | 42 | 32 | 28 | 12 | 36 | 15 | 26 | 16 | 34 | 26 |
| 270 | 45 | 41 | 30 | 36 | 30 | 5 | 30 | 12 | 20 | 4 | 10 | 10 |
| | Dry weight of precipitation on Pt-stirrer, mg | | | | | | | | | | | |
| 270 | 182 | 80 | 40 | 21 | 0.1 | 0.2 | 0.0 | 3.3 | 0.0 | 1.7 | 1.3 | 0.9 |

It is evident that the spin bath additives in accordance with the present invention have an improved ability to disperse solid and colloidal particles and to prevent the precipitation thereof in comparison with the spin bath additive disclosed in the Japanese Patent No. 48006409 and Japanese Patent Application No. 54101916. Examples 5–14.

The tests in these examples were performed as in example 2 but with the exeption that the additives used were as follows.

Compound 4.

Compound 4 has formula I, where R is a $C_{12}$–$C_{14}$ derived coco alkyl group, x is 2, n is 3, and A is the group $BOOCC_mH_{2m}$—, where B is sodium and m is 1.

Compound 5.

The same as Compound 4, but x is 3.

Compound 6.

Compound 6 is the same as Compound 4, but m is 2, x is 4 and B is hydrogen.

Compound 7.

Compound 7 has the formula I, where R is a $C_{18}$ derived tallow fatty alkyl group, x is 4, n is 3, and A is the group $BOOCC_mH_{2m}$—, where B is sodium and m is 1.

Compound 8.

Compound 8 is the same as Compound 7, but x is 5.

Compound 9.

Compound 9 is the same as Compound 7, but x is 6.

Compound 10.

Compound 10 is the same as Compound 7, but m is 2 and B is hydrogen.

Compound 11.

Compound 11 is the same as Compound 8, but m is 2 and B is hydrogen.

Compound 12.

Compound 12 is the same as Compound 9, but m is 2 and B is hydrogen.

The amounts added of compounds 4–12 are stated in the table below. The precipitation and dispersing tests gave the following results.

TABLE 4

| | Transmittance, % Compounds added | | | | | | | | | |
|---|---|---|---|---|---|---|---|---|---|---|
| | 4 | 5 | 6 | 6 | 7 | 8 | 9 | 10 | 11 | 12 |
| | Amount, ppm | | | | | | | | | |
| Time, h | 25 | 19 | 25 | 50 | 10 | 10 | 10 | 10 | 10 | 10 |
| 0 | 100 | 100 | 100 | 100 | 100 | 100 | 100 | 100 | 100 | 100 |
| 30 | 57 | 69 | 60 | 55 | 36 | 82 | 85 | 51 | 75 | 78 |
| 60 | 38 | 48 | 35 | 40 | 24 | 24 | 26 | 32 | 39 | 38 |
| 120 | 17 | 34 | 21 | 18 | 24 | 21 | 32 | 17 | 19 | 23 |
| 270 | 27 | 34 | 58 | 7 | 30 | 30 | 29 | 11 | 18 | 28 |
| | Dry weight of precipitation on Pt-stirrer after 270 min, mg | | | | | | | | | |
| | 0.9 | 5.7 | 4.0 | 0.6 | 1.2 | 5.5 | 3.0 | 2.8 | 3.2 | 5.6 |

From the results obtained, it is evident that the amphoteric compounds according to the invention exhibit an unexpected improvement regarding precipitation inhibitation and dispersion ability.

What is claimed is:

1. A spin bath system comprising a viscose spin bath and a viscose spin bath additive comprising an amphoteric surfactant having the general formula $$RNA\,(C_nH_{2n}NA)_{x-1}A \qquad (I)$$

where R represents a hydrogen or an aliphatic group with 1–24 carbon atoms, each A represents hydrogen, an aliphatic group with 1–24 carbon atoms or a $BOOCC_mH_{2m}$— group, where m is a number from 1–3, B is hydrogen or a salt-forming cation, n is a number from 2–3, x is 1–8, and the number of $BOOCC_mH_{2m}$— groups are from 1 to x+2, with the provision that the total number of carbon atoms in the aliphatic groups is from 8 to 45.

2. The spin bath system according to claim 1, wherein the viscose spin bath contains from 5 to 15% by weight of $H_2SO_4$, from 15 to 30% by weight of $Na_2SO_4$ and from 0 to 7% by weight of $ZnSO_4$.

3. The spin bath system according to claim 1, wherein the amphoteric surfactant is present in an amount of from 0.5 to 5000 ppm.

4. The spin bath system according to claim 1, wherein the amphoteric surfactant has the formula $$\text{RNA}\ (C_3H_6NA_1)_{x-1}A_1 \qquad \text{(II)}$$

where R, A and x have the same meaning as in formula I, and $A_1$ is a hydrogen or the group $BOOCC_mH_{2m}$, where B and m have the same meaning as in formula I.

5. The spin bath system according to claim 1, wherein the amphoteric surfactant is effective as a dispersant and precipitation reducing additive.

6. The spin bath system according to claim 1, wherein the amphoteric surfactant is effective to reduce the clogging of nozzles and slits in a process of making viscose filamentary and film material using the spin bath system.

7. A method for the regeneration of cellulose from a viscose solution comprising bringing the viscose solution in contact with a spin bath which comprises from about 0.5 to about 5000 ppm of an amphoteric surfactant having the formula I $$\text{RNA}\ (C_nH_{2n}NA)_{x-1}A \qquad \text{(I)}$$

where R represents a hydrogen or an aliphatic group with 1–24 carbon atoms, each A represents hydrogen, an aliphatic group with 1–24 carbon atoms or a $BOOCC_mH_{2m}$— group, where m is a number from 1–3, B is hydrogen or a salt-forming cation, n is a number from 2–3, x is 1–8, and the number of $BOOCC_mH_{2m}$— groups are from 1 to x+2, with the provision that the total number of carbon atoms in the aliphatic groups is from 8 to 45.

8. The process according to claim 7, wherein the spin bath further comprises from 5 to 15% by weight of $H_2SO_4$, from 15 to 30% by weight of $Na_2SO_4$ and from 0–7% by weight of $ZnSO_4$.

9. The process according to claim 7, wherein the amphoteric surfactant has the formula $$\text{RNA}\ (C_3H_6NA_1)_{x-1}A_1 \qquad \text{(II)}$$

where R, A and x have the same meaning as in formula I, and $A_1$ is a hydrogen or the group $BOOCC_mH_{2m}$, where B and m have the same meaning as in formula I.

10. A viscose spin bath additive comprising an amphoteric surfactant having the general formula I $$\text{RNA}\ (C_nH_{2n}NA)_{x-1}A \qquad \text{(I)}$$

where R represents a hydrogen or an aliphatic group with 1–24 carbon atoms, each A represents hydrogen, an aliphatic group with 1–24 carbon atoms or a $BOOCC_mH_{2m}$— group, where m is a number from 1–3, B is hydrogen or a salt-forming cation, n is a number from 2–3, x is 1–8, and the number of $BOOCC_mH_{2m}$— groups are from 1 to x+2, with the provision that the total number of carbon atoms in the aliphatic groups is from 8 to 45.

* * * * *